US007034242B1

(12) United States Patent
Shea et al.

(10) Patent No.: US 7,034,242 B1
(45) Date of Patent: Apr. 25, 2006

(54) ARC CHUTE AND CIRCUIT INTERRUPTER EMPLOYING THE SAME

(75) Inventors: John J. Shea, Pittsburgh, PA (US); Paul R. Rakus, Beaver Falls, PA (US); Thomas C. Pendrick, Clinton, PA (US); Francois J. Marchand, Jiangsu (CN); Glen C. Sisson, Monaca, PA (US)

(73) Assignee: Eaton Corporation, Cleveland, OH (US)

( * ) Notice: Subject to any disclaimer, the term of this patent is extended or adjusted under 35 U.S.C. 154(b) by 0 days.

(21) Appl. No.: 10/984,666

(22) Filed: Nov. 9, 2004

(51) Int. Cl.
*H01H 33/02* (2006.01)

(52) U.S. Cl. ..... 218/157; 218/156; 218/149; 218/34

(58) Field of Classification Search ..... 218/34–35, 218/37–38, 149, 151, 156–157
See application file for complete search history.

(56) References Cited

U.S. PATENT DOCUMENTS

| | | | | |
|---|---|---|---|---|
| 1,896,764 | A * | 2/1933 | Brainard | 218/34 |
| 4,082,931 | A | 4/1978 | Hayes | |
| 4,229,630 | A | 10/1980 | Wafer et al. | |
| 4,546,336 | A | 10/1985 | Petrie et al. | |
| 4,612,426 | A * | 9/1986 | Maier et al. | 218/151 |
| 4,748,301 | A | 5/1988 | Goldman et al. | |
| 4,950,852 | A | 8/1990 | Goldman et al. | |
| 4,973,805 | A | 11/1990 | Paton et al. | |
| 5,589,672 | A * | 12/1996 | Uchida et al. | 218/34 |
| 5,731,560 | A | 3/1998 | Nebon et al. | |
| 5,753,877 | A | 5/1998 | Hartzel et al. | |
| 5,753,878 | A | 5/1998 | Doughty et al. | |
| 5,818,003 | A | 10/1998 | Moldovan et al. | |
| 5,861,596 | A | 1/1999 | Grass et al. | |
| 5,899,323 | A | 5/1999 | Rakus | |
| 5,969,314 | A | 10/1999 | Rakus et al. | |
| 6,005,206 | A | 12/1999 | Rakus et al. | |
| 6,018,284 | A | 1/2000 | Rival et al. | |
| 6,066,821 | A | 5/2000 | Wehrli, III et al. | |
| 6,288,621 | B1 | 9/2001 | Rival | |
| 6,297,465 | B1 | 10/2001 | Groves et al. | |
| 6,417,474 | B1 | 7/2002 | Rakus et al. | |
| 6,703,576 | B1 | 3/2004 | Chou et al. | |

* cited by examiner

*Primary Examiner*—Lincoln Donovan
(74) *Attorney, Agent, or Firm*—Martin J. Moran

(57) ABSTRACT

A circuit interrupter arc chute includes first and second support portions, an exit portion supported by the support portions, and a plurality of arc plates supported by the support portions. The exit portion has one or more vent openings. The arc plates have a first edge offset from the exit portion and an opposite second edge distal from the exit portion. A plurality of insulating dividing members are disposed between the arc plates. The members have a first edge proximate the exit portion and an opposite second edge distal from the exit portion. The second edge of the members extends beyond the arc plate first edges and toward the arc plate second edges. The first edge of the dividing members extends beyond the arc plate first edge and away from the arc plate second edge.

18 Claims, 12 Drawing Sheets

ARC CHUTE AND CIRCUIT INTERRUPTER EMPLOYING THE SAME

BACKGROUND OF THE INVENTION

1. Field of the Invention

This invention pertains generally to circuit interrupters and, more particularly, to arc chutes for circuit breakers.

2. Background Information

Circuit breakers typically include a set of stationary electrical contacts and a set of moveable electrical contacts. The stationary and moveable contacts are in physical contact with one another when it is desired that the circuit breaker provide electricity therethrough to a load. When it is desired to interrupt the circuit, however, the moveable contacts are moved away from the stationary contacts, thus removing the moveable contacts from physical contact with the stationary contacts and creating a space therebetween.

The movement of the moveable contacts away from the stationary contacts results in the formation of an electrical arc in the space between the contacts beginning at the time the contacts are initially separated. Such an arc is undesirable for a number of reasons. For example, current flows through the circuit breaker to the load when it is desired that no such current should flow thereto. Additionally, the electrical arc extending between the contacts often results in vaporization or sublimation of the contact material itself, eventually resulting in destruction or pitting of the moveable and stationary contacts. It is thus desired to eliminate any such arcs as soon as possible upon their propagation.

The moveable contacts typically are mounted on arms that are contained in a pivoting assembly which pivots the moveable contacts away from the stationary contacts. An arc chute is provided along the path of each arm to break up and dissipate such arcs. Such arc chutes typically include a plurality of spaced apart arc plates mounted in a wrapper. As the moveable contact is moved away from the stationary contact, the moveable contact moves past the ends of the arc plates, with the arc being magnetically urged toward and between the arc plates. The arc plates are electrically insulated from one another such that the arc is broken up and extinguished by the arc plates. Examples of arc chutes are disclosed in U.S. Pat. Nos. 6,703,576; 6,297,465; 5,818,003; and 4,546,336.

U.S. Pat. No. 4,229,630 discloses deionization plates which may be utilized to direct the arc into the corners of each deionization plate so that the maximum length of the plate may be utilized for cooling and deionization of the resulting plasma. The plate has an opening therein which is generally in the shape of a V. However, the apex of the V-shaped opening is directed towards one of the frame sides of the arc chute. When inserted into the frame, these plates are positioned such that adjacent plates would have their apex directed to opposite side walls or, put another way, alternate plates would have their apex directed toward the same side.

U.S. Pat. No. 4,229,630 also discloses a pair of vertical arc gassing insulation plates secured to the deionization plate. The arc gassing insulation plates are disposed on opposite sides of the generally V-shaped opening and the arcing contact. The arc gassing insulation plates are made of a suitable arc gassing material, such as glass polyester or a ceramic-type material, and are inserted on either side of the arcing contact to increase the pressure at the arcing contact to drive the resulting arc more rapidly into the arcing chamber while concurrently allowing any arcs present at the main movable contacts to enter the arcing chamber.

Low voltage air circuit breakers interrupting relatively high currents (e.g., 100,000 A and higher) with molded housings and enclosed arc chambers may often sustain damage to their housings during short circuit interruption. Arcing energy at the corresponding power levels produces a pressure wave that may crack molded composite parts and collapse sheet-metal plates. Corresponding damage to the arc chute reduces its effectiveness, which increases arcing duration, energy release and chance of failure. In addition, residual ionized gas, with vaporized conductor material, may result in dielectric breakdown between the separable contacts even after the initial arc is gone.

Arc chutes are designed to encourage the arc to enter the metal arc plates. An arc can move quickly to the top edge of the arc plates and pass between top edges of some plates, thereby completely bypassing intermediate plates. This reduces the number of arc voltage drops and the effectiveness of the arc chute. This bypassing effect further creates current and gas flow patterns that tend to collapse groups of plates together, further reducing voltage divisions in the arc chute and its cooling effectiveness.

Another shortcoming of typical arc chute designs is that the gas flow from individual arc plate gaps recombines before exiting through the vent. This allows a few gaps that are directly above the center of the arc to dominate the gas flow. Relatively little gas flow (or arc mobility) occurs in the far forward or rearward plate gaps because they are competing with the central high-pressure gaps for exit flow area. The forward and rearward plates, and therefore the full volume of the arc chamber, are underutilized.

Retention of the arc chute top, even if it has a relatively large exit vent, is very difficult at interrupting currents above 100,000 A. The pressure wave may readily shatter a molded composite arc chute top and may pull fasteners through the molded material. Metal tops may emit unacceptable stray arc currents to the circuit breaker or enclosure ground. Metal arc chute tops may also attract arc from metal arc plates below, thereby conducting current in a manner that bypasses intermediate plates.

Accordingly, there is room for improvement in arc chutes and in circuit interrupters employing arc chutes.

SUMMARY OF THE INVENTION

These needs and others are met by the present invention, which provides a circuit interrupter arc chute including a plurality of electrically conductive arc plates supported by first and second support portions, and a plurality of insulating dividing members disposed between the arc plates. The arc plates have a first edge offset from an exit portion of the arc chute and an opposite second edge distal from the exit portion. The insulating dividing members have a first edge proximate the exit portion and an opposite second edge distal from the exit portion. The second edge of the insulating dividing members extends beyond the first edge of the arc plates and toward the second edge of the arc plates. The first edge of the insulating dividing members extends beyond the first edge of the arc plates and away from the second edge of the arc plates.

In accordance with one aspect of the invention, a circuit interrupter arc chute comprises: a first support portion; a second support portion; an exit portion supported by the first and second support portions, the exit portion having at least one opening; a plurality of electrically conductive arc plates supported by the first and second support portions, the arc plates having a first edge offset from the exit portion and an opposite second edge distal from the exit portion; and a plurality of insulating dividing members disposed between the arc plates, the insulating dividing members having a first edge proximate the exit portion and an opposite second edge distal from the exit portion, wherein the second edge of the insulating dividing members extends beyond the first edge of the arc plates and toward the second edge of the arc plates, and wherein the first edge of the insulating dividing members extends beyond the first edge of the arc plates and away from the second edge of the arc plates.

The first and second support portions may be first and second side portions; the exit portion may be a top portion; the first and second edges of the arc plates may be top and bottom edges, respectively; the first and second edges of the insulating dividing members may be top and bottom edges, respectively; the arc plates and the insulating dividing members may be generally normal to the top portion and to the first and second side portions; the at least one opening may be one opening; the top edge of the arc plates may be offset below the one opening of the top portion; and the top edge of the insulating dividing members may be within the one opening of the top portion.

The at least one opening may be a plurality of openings; the top edge of the arc plates may be offset below the openings of the top portion by a first distance; and the top edge of the insulating dividing members may be offset below the openings by a second distance that is smaller than the first distance.

Each one of the insulating dividing members may be disposed between and separated from an adjacent pair of the arc plates.

The at least one opening of the exit portion may be a first opening; the exit portion may comprise a molded top and a top frame, the molded top having a second opening corresponding to the first opening of the exit portion, a molded rim around the second opening of the molded top, and a recessed area. The top frame may have a third opening corresponding to the first opening of the exit portion and be larger than the second opening. The top frame may rest in the recessed area of the molded top. The molded rim of the molded top may be adjacent to the third opening.

The molded top may be made of an insulating material; and the top frame may be electrically conductive and plated with a non-conductive material.

Each of the first and second support portions may include a wedge portion proximate the exit portion, the wedge portion being adapted to direct or divert gas toward the at least one opening of the exit portion.

The wedge portion may be made of an insulating material and may include a plurality of first grooves adapted to engage the insulating dividing members and a plurality of opposite second grooves adapted to engage the arc plates.

As another aspect of the invention, an arc chute for a circuit interrupter comprises: a first support portion; a second support portion; an exit portion supported by the first and second support portions, the exit portion having at least one opening; a plurality of electrically conductive arc plates supported by the first and second support portions, the arc plates having a first edge offset from the exit portion and an opposite second edge distal from the exit portion; a plurality of insulating dividing members disposed between the arc plates, the insulating dividing members having a first edge proximate the exit portion and an opposite second edge distal from the exit portion; and at least one gassing member, wherein the second edge of the insulating dividing members extends beyond the first edge of the arc plates and toward the second edge of the arc plates, wherein the first edge of the insulating dividing members extends beyond the first edge of the arc plates and away from the second edge of the arc plates, wherein the first and second support portions have an edge distal from the exit portion, and wherein the at least one gassing member is disposed at least substantially about the edge of the first and second support portions.

The at least one gassing member may be a single gassing member having a general U-shape with a first leg disposed substantially along the edge of the first support portion, with a second leg disposed substantially along the edge of the second support portion, and with a base disposed between the first and second legs and between the first and second support portions.

One of the arc plates may include an arc horn; and the base may be proximate the arc horn.

The at least one gassing member may include a first gassing member disposed parallel to the edge of the first support portion and a second gassing member disposed parallel to the edge of the second support portion.

The first and second gassing members may be parallel to the first and second support portions, respectively, and may include a plurality of slots receiving the arc plates.

As another aspect of the invention, a circuit breaker comprises: a first power terminal; a second power terminal; a stationary contact electrically connected to the second power terminal; a movable contact electrically connected to the first power terminal; an operating mechanism adapted to open and closed the stationary contact and the movable contact; and an arc chute comprising: a first support portion, a second support portion, an exit portion supported by the first and second support portions, the exit portion having at least one opening, a plurality of electrically conductive arc plates supported by the first and second support portions, the arc plates having a first edge offset from the exit portion and an opposite second edge distal from the exit portion, and a plurality of insulating dividing members disposed between the arc plates, the insulating dividing members having a first edge proximate the exit portion and an opposite second edge distal from the exit portion, wherein the second edge of the insulating dividing members extends beyond the first edge of the arc plates and toward the second edge of the arc plates, and wherein the first edge of the insulating dividing members extends beyond the first edge of the arc plates and away from the second edge of the arc plates.

The exit portion may be a top portion. The first and second edges of the arc plates may be top and bottom edges, respectively. The first and second edges of the insulating dividing members may be top and bottom edges, respectively. The insulating dividing members may extend above the top edge of the arc plates and overlap the arc plates, in order to prevent an arc from the stationary contact and the movable contact, when opened by the operating mechanism, from reaching the top edge of the arc plates, without lengthening, and to cause the arc to pass below the insulating dividing members.

Each one of the insulating dividing members may be disposed between and separated from an adjacent pair of the arc plates, in order to protect the top edge of the arc plates and prevent breakdown of an arc from the stationary contact and the movable contact, when opened by the operating mechanism, down the arc plates during interruption of the arc.

The top portion may comprise a molded top having a bottom surface with a plurality of grooves. Each of the insulating dividing members may include a top surface which interlocks with a corresponding one of the grooves of the bottom surface of the molded top.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

The present invention is described in association with a circuit breaker, although the invention is applicable to a wide range of circuit interrupters.

Although reference is made herein to terms such as "top," "bottom," "above," "below" and "side," it will be appreciated that those relative terms apply to one frame of reference and that equivalent frames of reference may be employed. For example, an object having a "top," a "bottom," and four sides may be rotated 180 degrees such that the "bottom" is now above the "top". As another example, the object having the "top," the "bottom," and the four sides may be rotated 90 degrees such that one of the four sides is now on top and is now "above" another one of the sides that is now on bottom.

Figure 1:
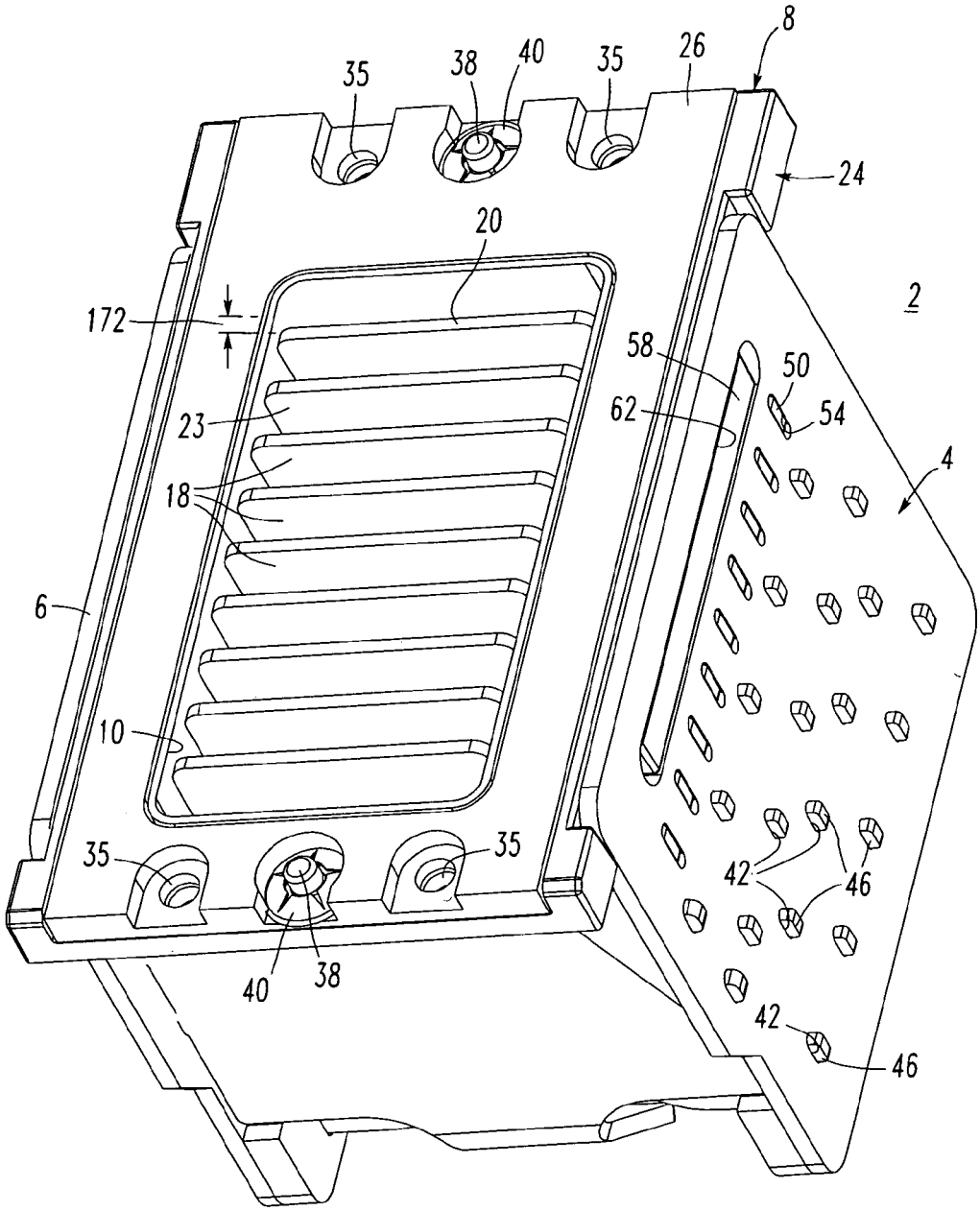
FIG. 1 is an isometric view of an arc chute in accordance with the present invention.
Figure 15:
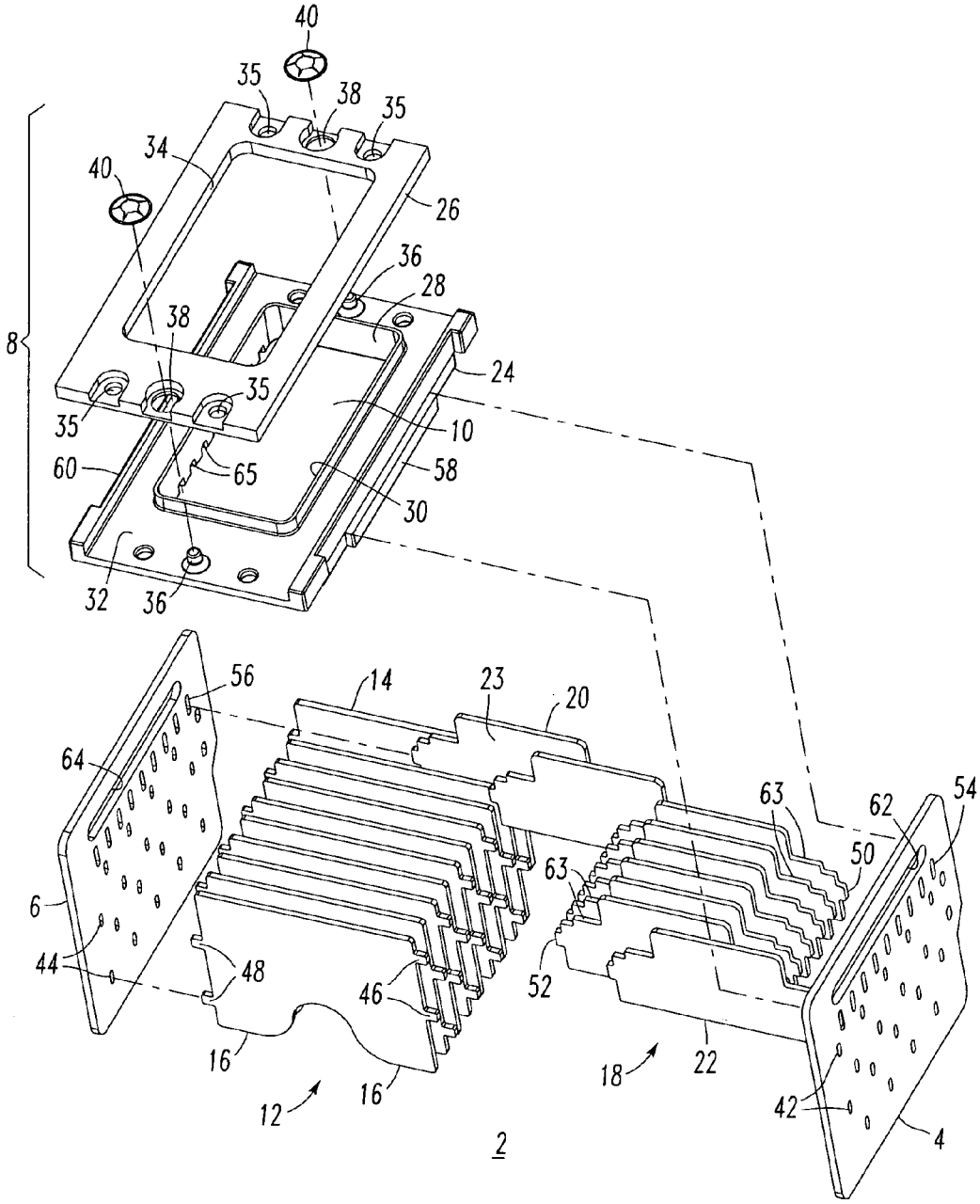
FIG. 15 is an exploded view of the arc chute of FIG. 1.

Referring to FIGS. 1 and 15, a circuit interrupter arc chute 2 includes a first support or side portion 4, a second support or side portion 6 and an exit or top portion 8 supported by the first and second side portions 4,6 (e.g., made of a suitable non-conductive composite material). The top portion 8 has one or more vent openings 10 (only one vent opening 10 is shown in FIGS. 1 and 15). A plurality of generally parallel electrically conductive arc plates 12 (as shown in FIG. 15) (e.g., without limitation, nickel plated; 1010 magnetic steel plates) are supported by the first and second side portions 4,6. The arc plates 12 have a first or top edge 14 offset from the top portion 8 and an opposite second or bottom edge 16 distal from the top portion. A plurality of insulating dividing members, such as baffles 18, are disposed between the arc plates 12. The baffles 18 have a first or top edge 20 proximate the top portion 8 and an opposite second or bottom edge 22 distal from the top portion. The bottom edge 22 of the baffles 18 extends beyond the top edge 14 of the arc plates 12 and toward the bottom edge 16 of the arc plates. The top edge 20 of the baffles 18 extends beyond the top edge 14 of the arc plates 12 and away from the bottom edge 16 of the arc plates.

As best shown in FIG. 15, the arc plates 12 and the baffles 18 are generally normal to the top portion 8 and to the first and second side portions 4,6. The top edge 14 of the arc plates 12 is offset below the opening 10 of the top portion 8. The top edge 20 of the baffles 18 is within the top portion opening 10 (as best shown in FIG. 1). The baffles 18 include a top portion 23 having the top edge 20 thereof. The top portion 23 extends upward into the single vent opening 10 (as best shown in FIG. 1), in order to prevent arcing over the top edge 20 of the baffles 18. Although not shown, the top portion 23 may alternatively extend up through the vent opening 10.

Figure 8:
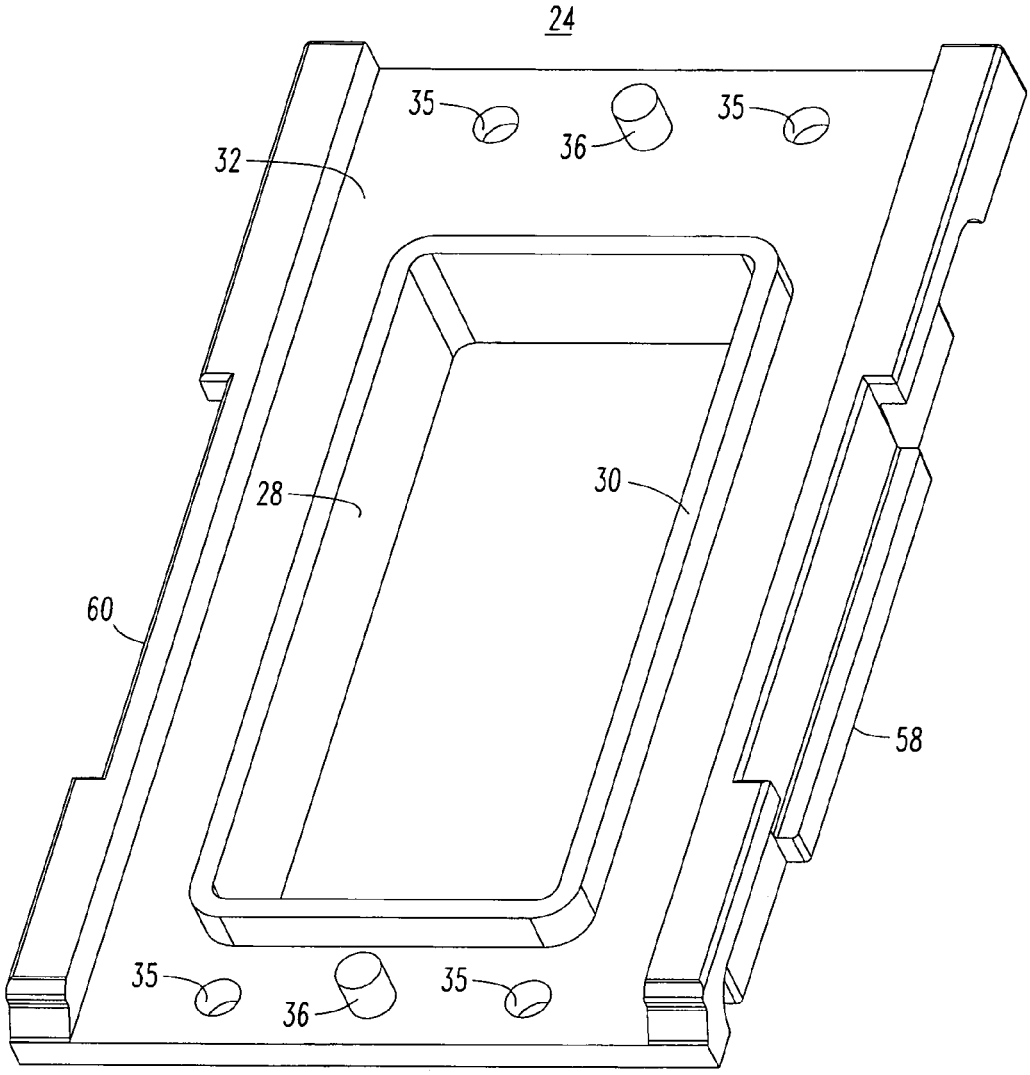
FIG. 8 is an isometric view of the molded arc chute top of FIG. 1.
Figure 10:
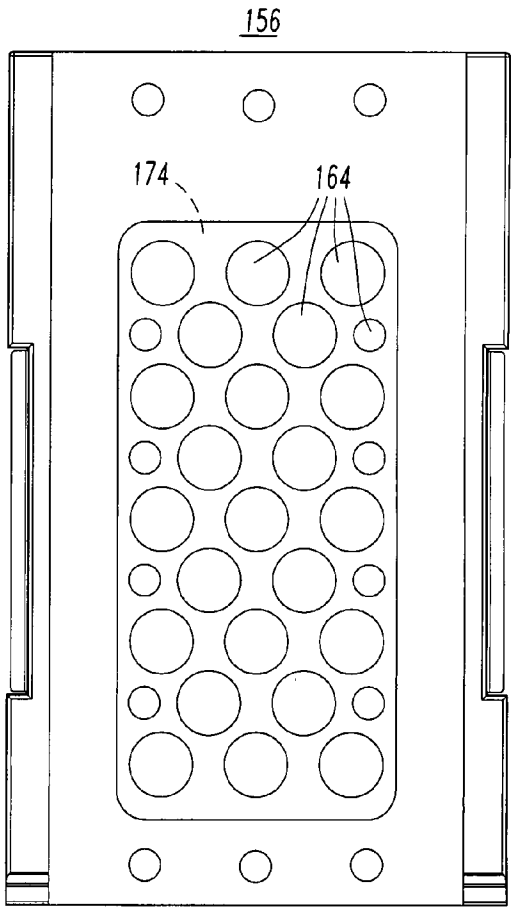
FIGS. 9–12 are plan views of other molded arc chute tops in accordance with other embodiments of the invention.
Figure 9:
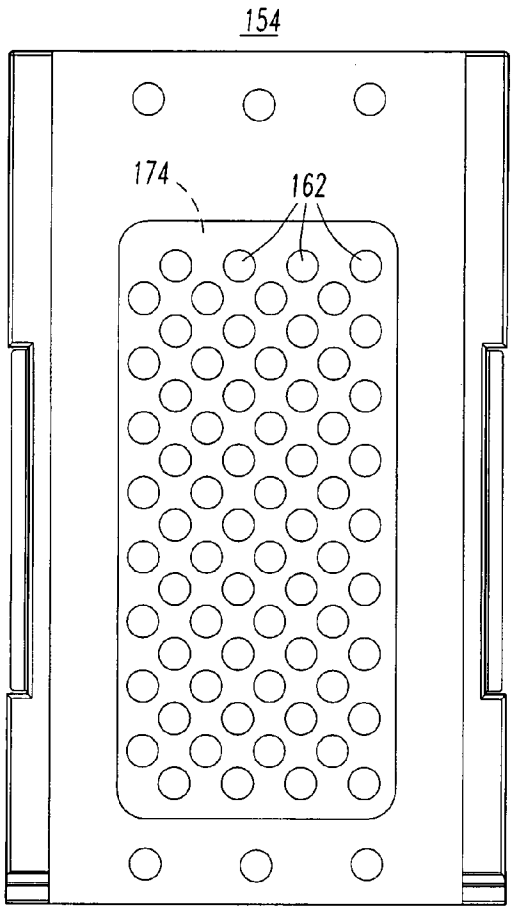
Figure 12:
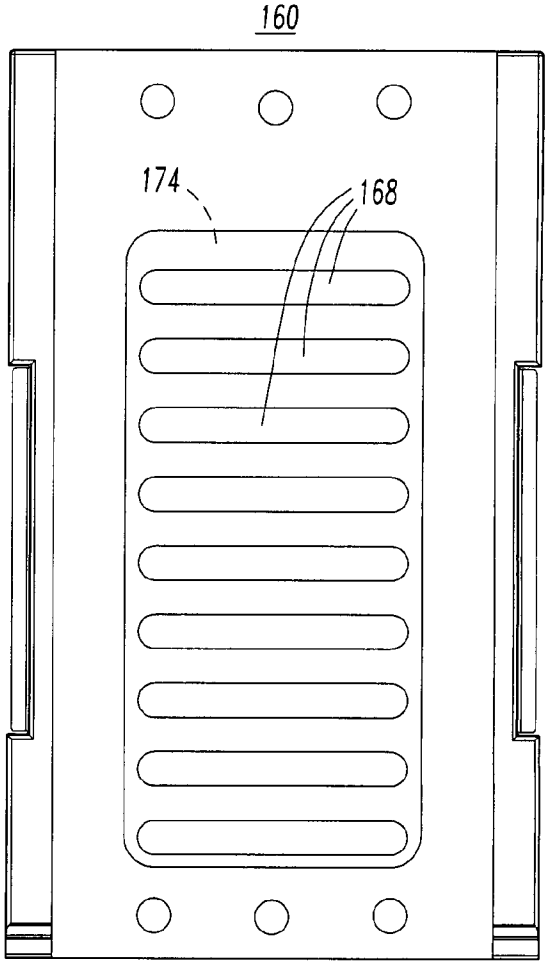
Figure 11:
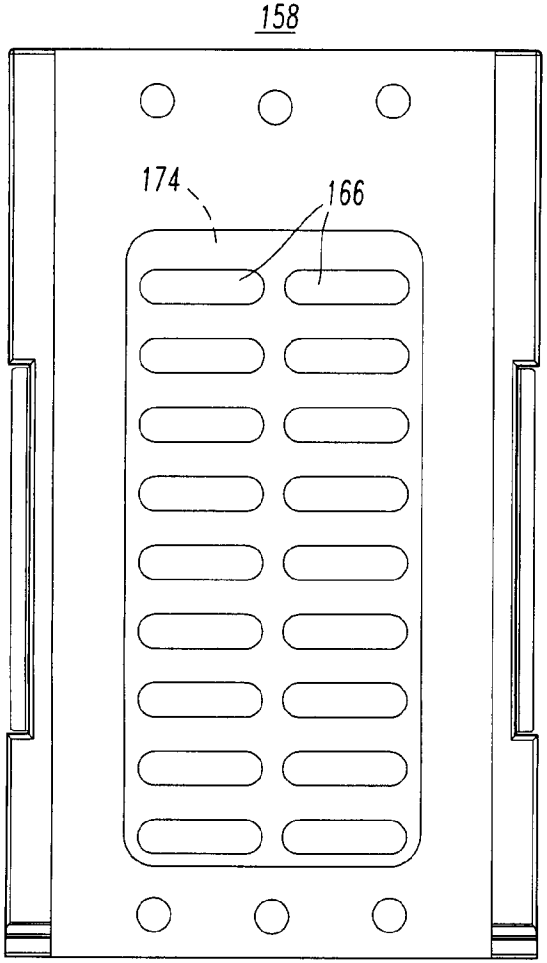

Continuing to refer to FIG. 15, the top portion 8 includes a molded top 24 (e.g., without limitation, made of a suitable insulating material, such as, for example, glass filled polyester) and a top frame 26. The molded top 24 (as best shown in FIG. 8) has an opening 28 corresponding to the opening 10 of the top portion 8, a molded rim 30 around the opening 28, and a recessed area 32. The top frame 26 has an opening 34 corresponding to the top portion opening 10. The opening 34 is larger than the openings 10,28. The top frame 26 rests in the recessed area 32 of the molded top 24, with the molded rim 30 being adjacent to the opening 34. The top frame 26 is electrically conductive (e.g., without limitation, made of steel) and is plated with a suitable non-conductive material. The electrical insulation of the molded top 24, the non-conductive plating of the top frame 26 and the non-conductive baffles 18 protect the top edges 14 of the arc plates 12. This also prevents exposing the top frame 26 to the direct flow of exhaust gas. Furthermore, the arc plates 12 being relatively close to the baffles 18 prevents breakdown of the arc down the arc plates during the interruption of an arc. The arcs are forced to stay below the baffles 18 and are divided between the arc plates 12. Moreover, the baffles 18 interlock with grooves, such as notches 65 (FIG. 15), of the molded top 24, thereby preventing the arc from bypassing the resulting interlocking fit. Also, with the baffles 18, the arc will not take a relatively long path from one arc plate 12, out the one or more vents 10, bypass an intermediate arc plate, and return to another arc plate. Otherwise, without the baffles 18, the arc could travel to the top of the arc plates 12 and then re-combine, thereby bypassing some of the arc plates.

The top frame 26 and the molded top 24 also include openings 35 to retain the arc chute 2 to a circuit breaker housing (e.g., 80 of FIG. 2) and prevent breakage of the molded top 24. The molded plastic rim 30 around the top frame 26 prevents exposing such frame 26 to the direct flow of exhaust gas. Protecting the metal top frame 26 in this way reduces the possibility of stray arc current finding its way to ground through the conductive metal top frame 26. This structure also allows the top frame 26 to be plated, rather than be insulated, with, for example, a relatively thick paint or polymer coating, for relatively lower cost manufacture.

The molded top 24 includes a pair of tabs 36. The top frame 26 includes a pair of openings 38 adapted to receive the tabs 36 and a pair of fasteners 40 (e.g., threaded fasteners; press-fit or snap-fit fasteners interlocked directly with the molded top 24; push on retaining nuts) adapted to engage and retain the tabs 36. Alternatively, the top frame 26 may be interlocked directly (not shown) with the arc chute side portions 4,6.

The first and second side portions 4,6 include a plurality of openings 42,44. The arc plates 12 include a plurality of tabs 46,48 that engage the first and second side portions 4,6 at the openings 42,44, respectively, thereof. The baffles 18 similarly include tabs 50,52 that engage the first and second side portions 4,6 at openings 54,56, respectively, thereof. The molded top 24 includes tabs 58,60 that engage the first and second side portions 4,6 at openings 62,64, respectively, thereof.

EXAMPLE 1

Although not shown in FIG. 1, the surfaces 63 of the baffles 18 may interlock with the notches 65 on the bottom side of the molded top 24, in order to provide added mechanical support and to prevent arc bypass.

Figure 2:
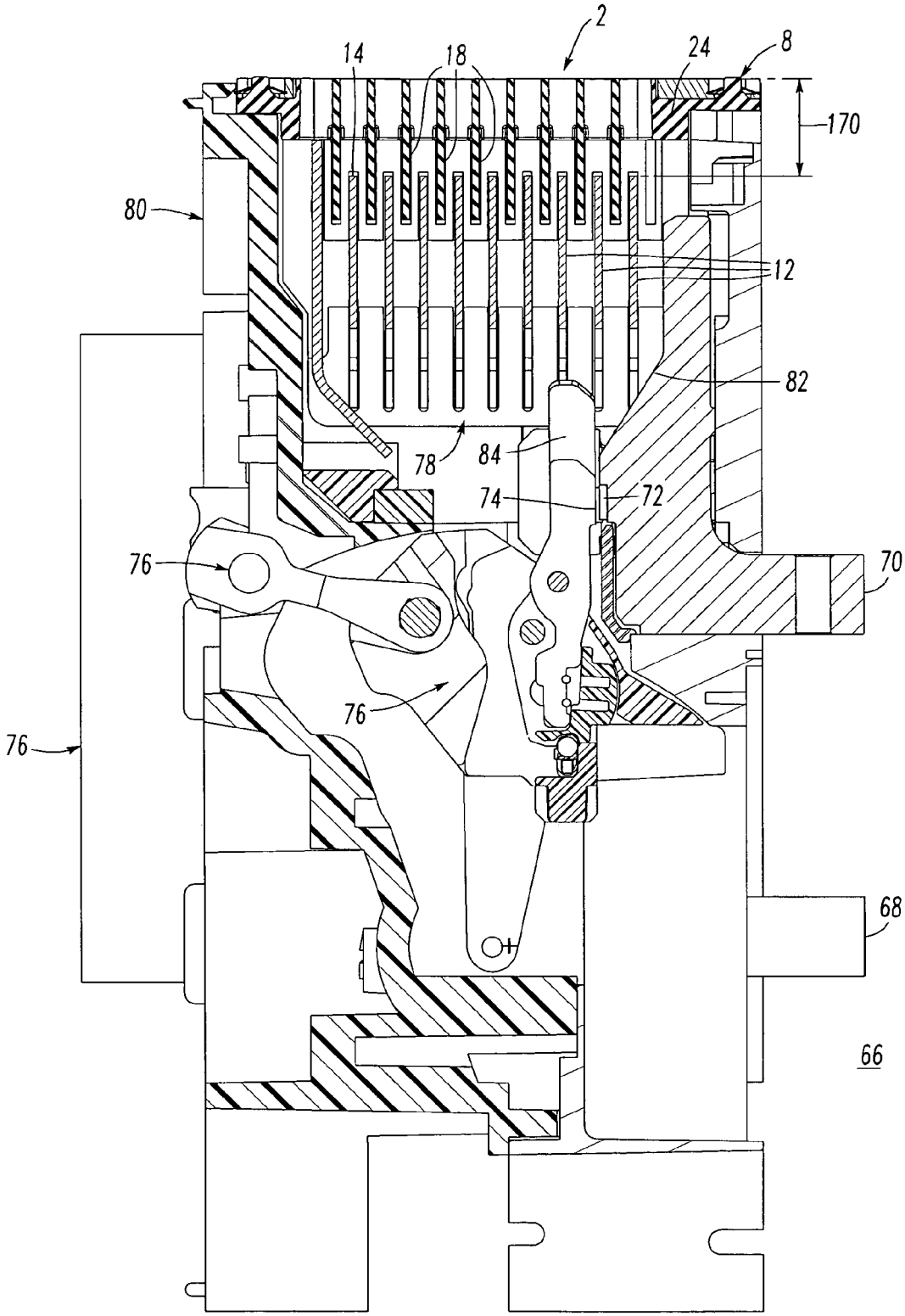
FIG. 2 is a vertical section through a circuit breaker incorporating the arc chute of FIG. 1.

FIG. 2 shows a circuit breaker 66 incorporating the arc chute 2 of FIGS. 1 and 15. The circuit breaker 66 includes a first power terminal 68, a second power terminal 70, a stationary contact 72 electrically connected to the second power terminal 70, a movable contact 74 electrically connected by a suitable flexible (e.g., braided) conductor (not shown) to the first power terminal 68, an operating mechanism 76 adapted to open and closed the contacts 72,74; and the arc chute 2. Each one of the baffles 18 is disposed between and is separated from an adjacent pair of the arc plates 12. As best shown in FIG. 2, the baffles 18 extend above the top edge 14 of the arc plates 12 and overlap such arc plates, in order to prevent an arc from the stationary contact 72 and the movable contact 74, when opened by the operating mechanism 76, from reaching the top edge 14 of the arc plates 12, without lengthening, and to cause the arc to pass below the baffles 18. The baffles 18 protect the arc plate top edges 14 and prevent breakdown of an arc down the arc plates 12 during interruption of the arc.

In order to relieve the pressure in the arc chamber 78 without damaging the housing 80 of the circuit breaker 66 or the arc chute 2, the top portion 8 of the arc chute 2 has the relatively large unrestricted vent opening 10 (as best shown in FIG. 1). Venting the arc gas freely also encourages arc movement upward from the separable contacts 72,74 onto the arc running features (e.g., the stationary arc runner 82 and the moving arcing contact finger extensions 84). Quick movement of the arc toward the arc chute 2 divides the arc as quickly as possible, thereby inserting voltage and limiting the current and, therefore, reducing energy release, duration and damage resulting from the interruption. Finally, rapid exhaust of ionized arc gas reduces occurrence of dielectric breakdown which can occur between the open contacts 72,74 in the moments after interruption due to residual gas.

In order to prevent the arc from reaching the arc plate top edges 14, the insulating dividing baffles 18 are positioned between each metal arc plate 12. The metal arc plates 12 stop a substantial distance below the molded top 24 (FIG. 15) to prevent current from creeping over the surface of the molded top 24 from metal arc plate 12 to metal arc plate 12. The baffles 18 extend above the top of the arc plates 12 and overlap the arc plates 12 by a suitable distance in order to prevent the arc from reaching the arc plate top edges 14, without lengthening, and to pass below the insulating dividing baffles 18. The presence of the baffles 18 eliminates the occurrence of arcing across the top edges 14, bypassing some, and greatly reduces the occurrence of arc plate bending that otherwise would result.

By partitioning the exit vent opening 10 (FIG. 1) into individual channels that begin between the metal arc plates 12, the insulating dividing baffles 18 also encourage strong gas flow and arc movement in all of the plate intervals. This even distribution of flow and arcing between the bottom and top of the arc chute 2 makes maximum use of the arc chute volume, mass and number of arc plates 12. The arrangement described here allows the use of relatively fewer metal arc plates 12, which are utilized more effectively, with larger gas flow gaps between them.

EXAMPLE 2

Although relatively thicker metal arc plates 12 may be employed to reduce bending, in the event that two or more arc plates 12 bend toward each other, the insulating dividing baffle 18 between them prevents contact, and thereby maintains the effective cooling surface area and number of voltage divisions in the arc chute 2.

Figure 3:
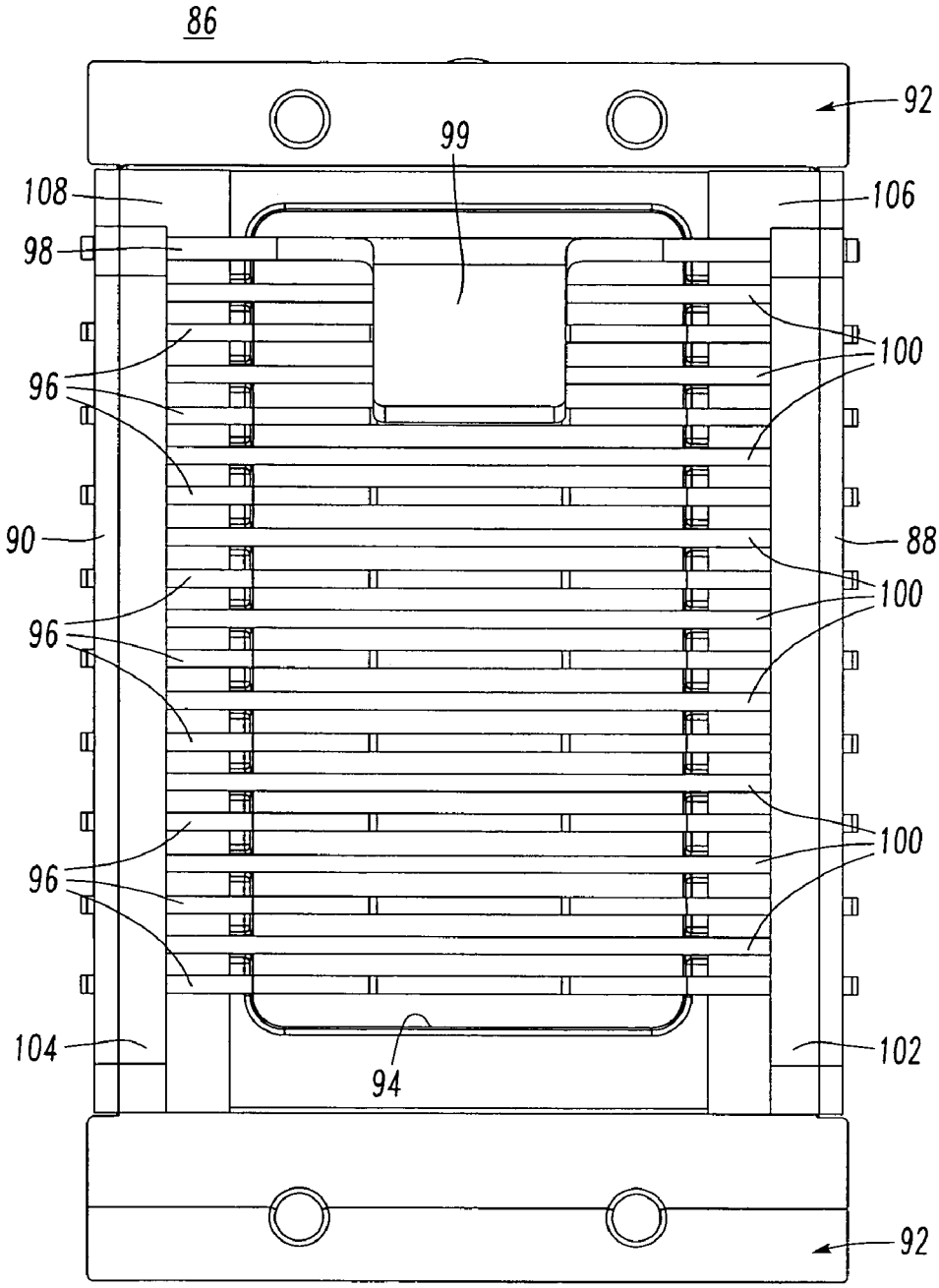
FIG. 3 is a bottom (with respect to the orientation of FIG. 2) plan view of another arc chute in accordance with another embodiment of the invention.
Figure 6:
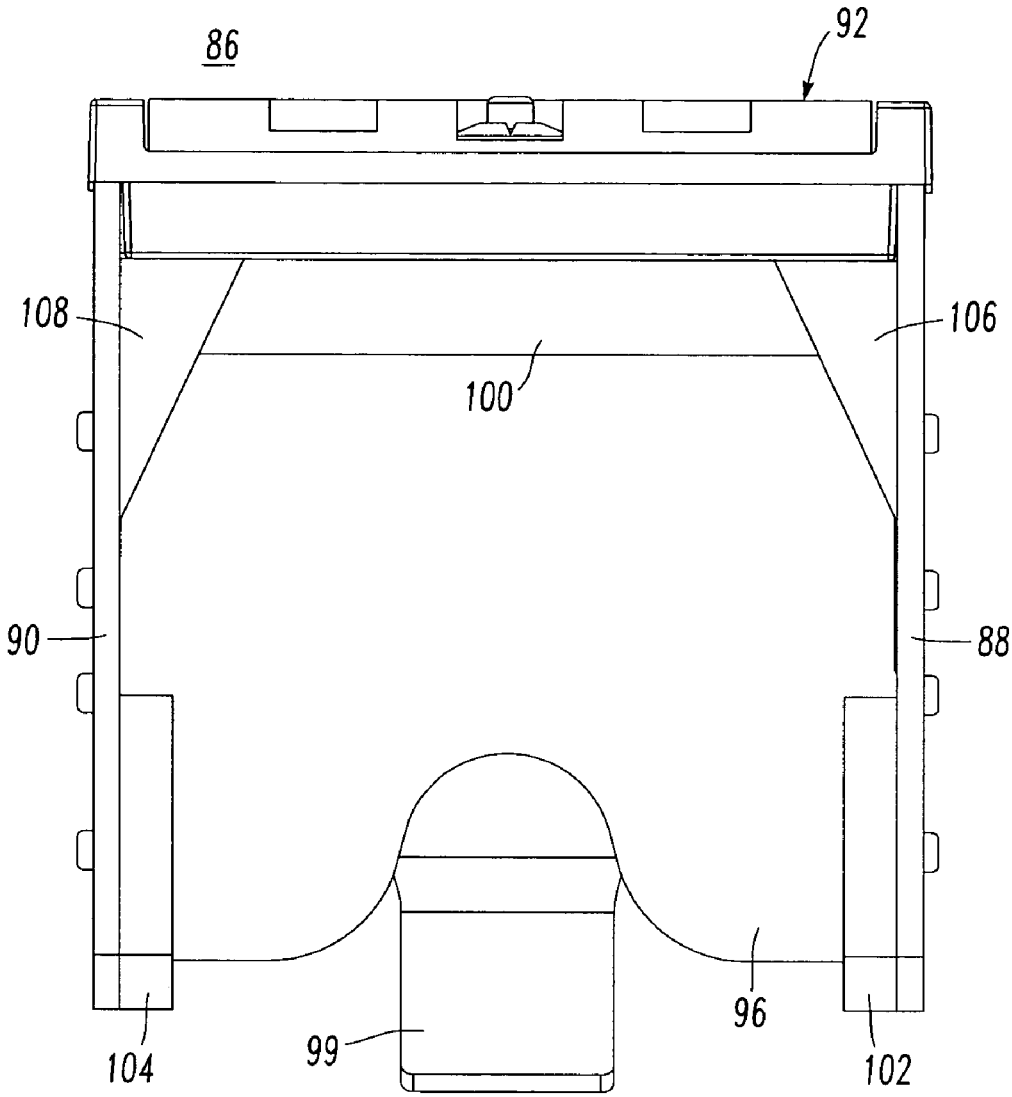
FIG. 6 is a vertical elevation view of the arc chute of FIG. 3.
Figure 13:
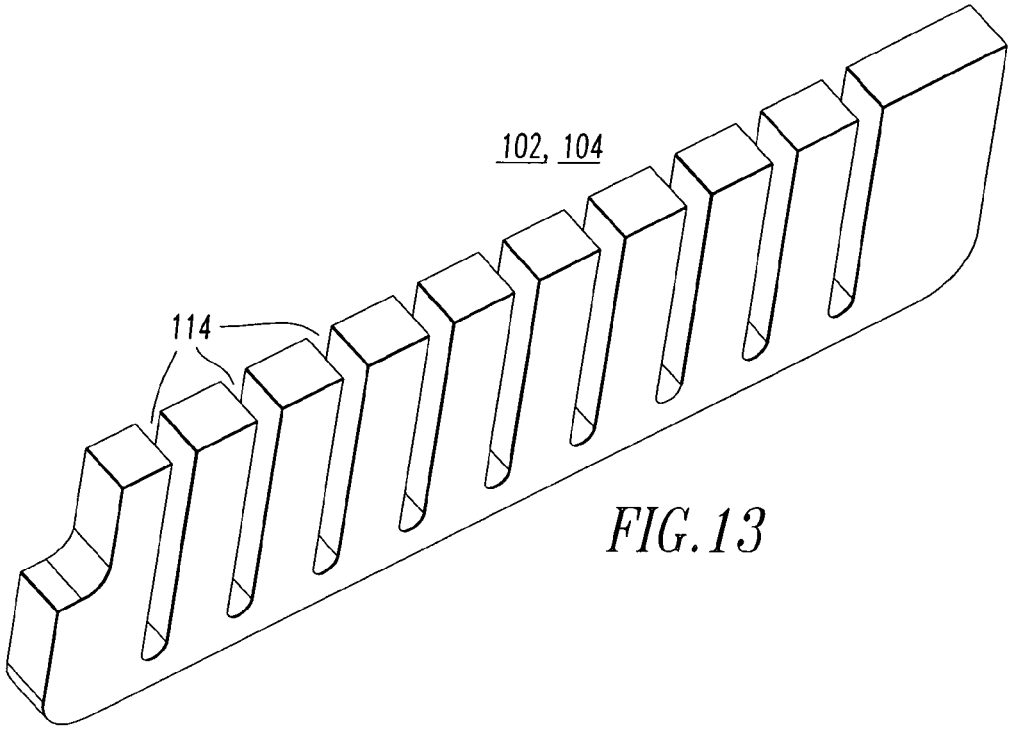
FIG. 13 is an isometric view of the comb of FIG. 3.
Figure 14:
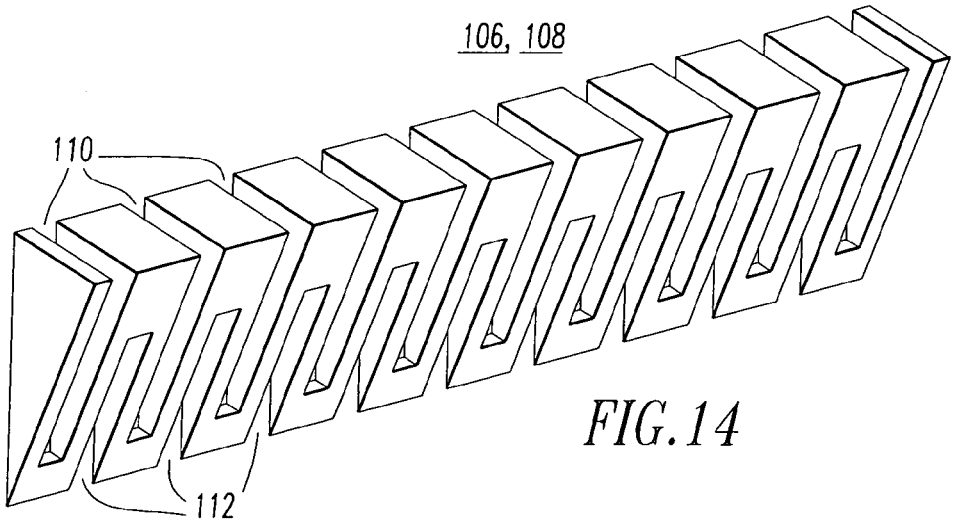
FIG. 14 is an isometric view of the wedge of FIG. 1.

FIG. 3 shows another arc chute 86 that is somewhat similar to the arc chute 2 of FIG. 1. The arc chute 86 includes a first support or side portion 88, a second support or side portion 90, an exit or top portion 92, a vent opening 94, a plurality of generally parallel electrically conductive arc plates 96 including a top arc plate 98 having an arc horn 99, and a plurality of insulating dividing members, such as baffles 100. The arc chute 86 further includes a pair of gassing combs 102,104 (as best shown in FIG. 13) and a pair of arc chute gas diverting wedges 106,108 (as best shown in FIGS. 6 and 14) (e.g., without limitation, made of a suitable insulating material, such as, for example, polyester; glass filled polyester; ceramic filled polyester (e.g., $Al_2O_3$); GPO3 (red glass polyester).

Figure 4:
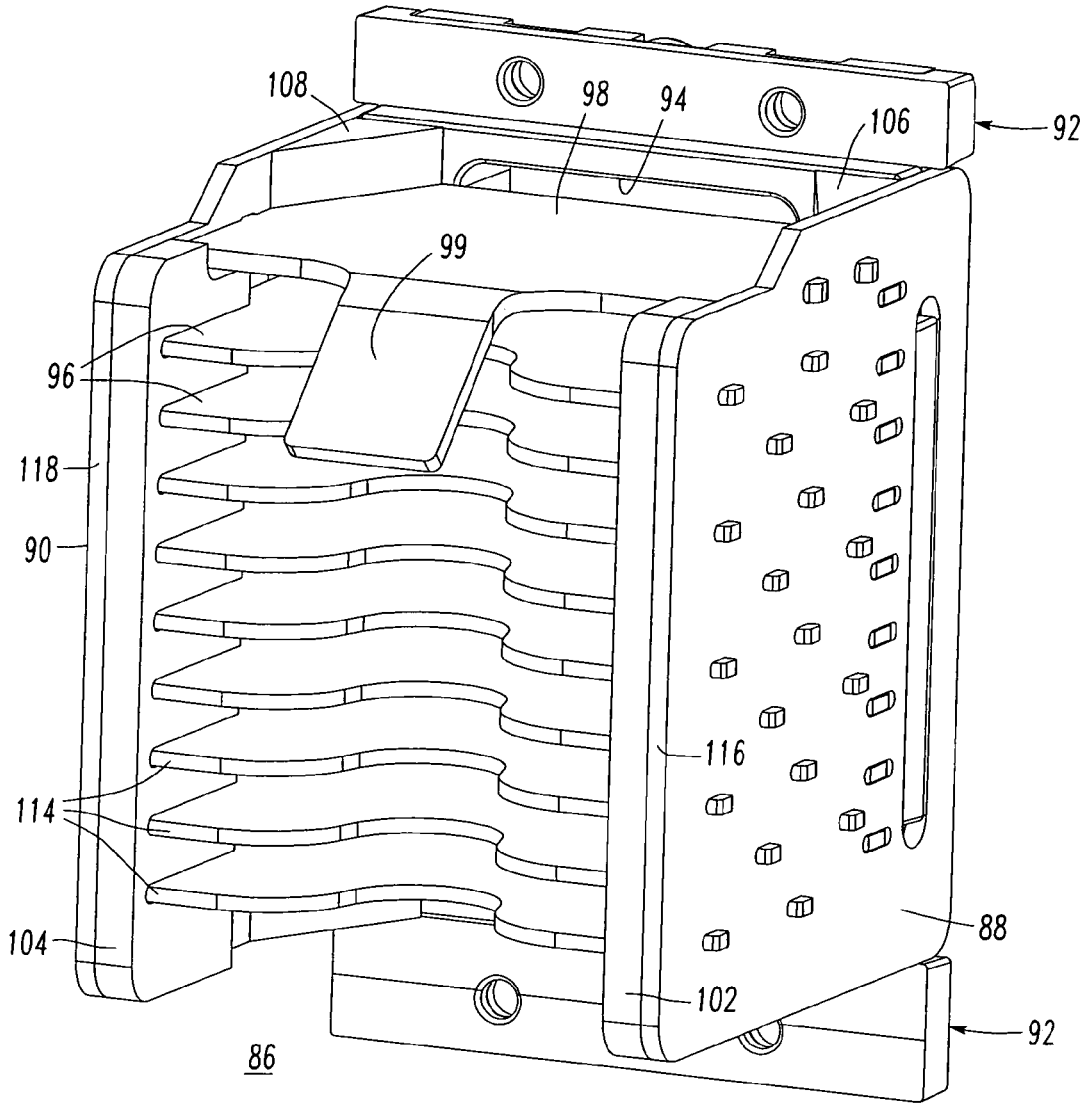
FIG. 4 is an isometric view of the arc chute of FIG. 3.

As best shown in FIG. 4, the first and second side portions 88,90 include the respective wedges 106,108 proximate the top portion 92. The wedges 106,108 (FIG. 14) are adapted to direct or divert gas toward the vent opening 94 of the top portion 92. The wedges 106,108 include a plurality of first or upper grooves 110 adapted to engage and be held in place by the insulating dividing baffles 100 (FIG. 3) and a plurality of opposite second or lower grooves 112 adapted to engage and be held in place by the arc plates 96.

The gassing combs 102,104 also include a plurality of slots or grooves 114 (as best shown in FIG. 13) adapted to engage and be held in place by the arc plates 96. The gassing combs 102,104 are disposed at least substantially about the bottom edges 116,118 (FIG. 4) of the first and second side portions 88,90, respectively. As shown in FIG. 4, the gassing combs 102,104 are disposed parallel to the respective bottom edges 116,118. The gassing combs 102,104 are made of a suitable arc gassing material (e.g., without limitation, cellulose filled melamine formaldehyde, urea (CMF); a suitable insulator; alumina trihydrate (ATH) filled glass polyester) and are inserted on either side of the arcing contact (not shown) to increase the pressure at the arcing contact to drive the resulting arc more rapidly into the arcing chamber (not shown) while concurrently allowing any arcs present at the main movable contact(s) (not shown) to enter the arcing chamber. This cools the arc.

The insulating dividing baffles 100 of FIG. 3 interlock with grooves 110 of the wedges 106,108 of FIG. 14, which prevents a route for an arc to bypass the arc plates 96 by passing above the insulating dividing baffles 100. Interlocking the insulating dividing baffles 100 with such grooves 110 also provides additional support against collapsing the arc plates 96 into groups or failure of the structure of the arc chute 86. This lends mechanical support to the insulating dividing baffles 100 that extend upward into the arc chute vent opening 94, definitively preventing arcing over the tops of the insulating dividing baffles 100.

Figure 5:
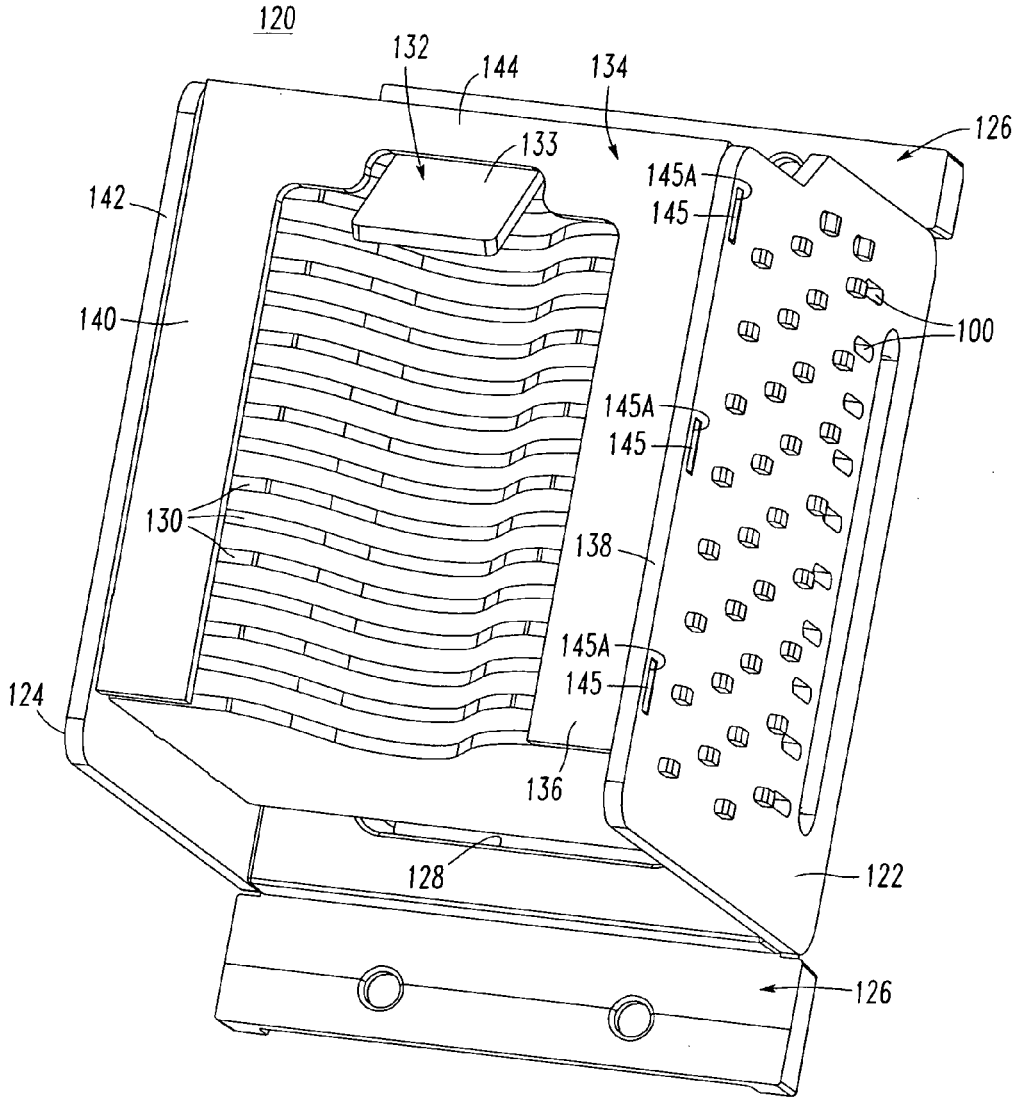
FIG. 5 is an isometric view of another arc chute in accordance with another embodiment of the invention.

FIG. 5 shows another arc chute 120 that is somewhat similar to the arc chute 2 of FIG. 1. The arc chute 120 includes a first support or side portion 122, a second support or side portion 124, an exit or top portion 126, a vent opening 128, a plurality of generally parallel electrically conductive arc plates 130 including a top arc plate 132 having an arc horn 133, and a plurality of insulating dividing members, such as the baffles 100 (as best shown in FIG. 4). The arc chute 120 further includes a single arc chute gassing "goal post" member 134. This member 134 has a general U-shape with a first leg 136 disposed substantially along the bottom edge 138 of the first support portion 122, with a second leg 140 disposed substantially along the bottom edge 142 of the second support portion 124, and with a base 144 disposed between the first and second legs 136,140 and between the first and second support portions 122,124. The base 144 is proximate the arc horn 133. The legs 136,140 include tabs 145 that engage openings 145A of the support portions 122,124, as is shown with leg 136 and support portion 122.

Figure 7:
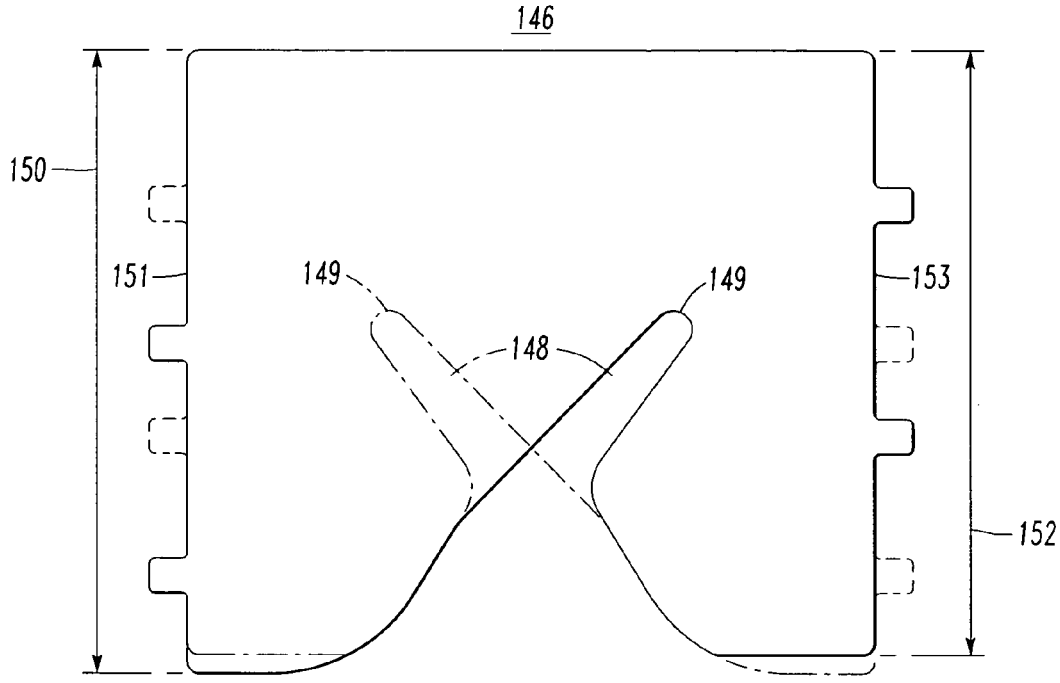
FIG. 7 is a plan view of an arc plate in accordance with another embodiment of the invention.

FIG. 7 shows an arc running arc plate 146 suitable for use with the arc chutes 2, 86, 120. Adjacent pairs of the arc plates 146 (one of the two arc plates 146 is shown in solid in FIG. 7 and the other is shown in phantom line drawing) have slots 148 therein with ends 149 directed to opposite ones of the first and second support portions (not shown) (e.g., 4,6 of FIG. 1). This tends to draw the arc from the bottom left to the top right of FIG. 7. Also, the arc gets stretched further than a straight vertical (with respect to FIG. 7) line (not shown). For each of the arc plate pairs, each of the arc plates 146 has a first width 150 on one side 151 adjacent one of the first and second support portions and a second smaller width 152 on the opposite side 153 adjacent the other one of the first and second support portions. The side 153 having the smaller width 152 is disposed proximate the end 149 of the slot 148.

EXAMPLE 3

The difference in the widths 150,152 may be, for example, 0.1 inch. This difference provides a gap that doubles the leading edge plate spacing, thereby making it easier for an arc, if formed on the outer contact arms, to enter the arc plates 12. A larger arc plate spacing provides less resistance to arc motion than tightly spaced arc plates. Otherwise, the arc might "stall" at the leading edge and track on the surface.

FIGS. 9–12 show other molded arc chute tops 154,156, 158,160, which are somewhat similar to the molded top 24 of FIG. 8. Here, instead of the single vent opening 28 of FIG. 8, there are a plurality of vent openings 162,164,166,168 in the respective molded tops 154,156,158,160. In these examples, the top edge 14 of the arc plates 12 (FIG. 2) is offset below the vent openings 162,164,166,168 by a first distance 170 (FIG. 2), while the top edge 20 of the insulating dividing members 18 (FIG. 1) is offset below the vent openings 162,164,166,168 by a second distance 172 (FIG. 1) that is smaller than the first distance 170. For example, the top edge 20 of the insulating dividing members 18 (FIG. 1) may engage or be proximate the surface 174 (shown in hidden line drawing) of the molded tops 154,156,158,160.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the claims appended and any and all equivalents thereof.

What is claimed is:

1. A circuit interrupter arc chute comprising:

a first support portion;

a second support portion;

an exit portion supported by said first and second support portions, said exit portion having at least one opening;

a plurality of electrically conductive arc plates supported by said first and second support portions, said arc plates having a first edge offset from said exit portion and an opposite second edge distal from said exit portion; and a plurality of insulating dividing members disposed between said arc plates, said insulating dividing members having a first edge proximate said exit portion and an opposite second edge distal from said exit portion, wherein the second edge of said insulating dividing members extends beyond the first edge of said arc plates and toward the second edge of said arc plates, wherein the first edge of said insulating dividing members extends beyond the first edge of said arc plates and away from the second edge of said arc plates, wherein said at least one opening of said exit portion is a first opening; wherein said exit portion comprises a molded top and a top frame, said molded top having a second opening corresponding to the first opening of said exit portion, a molded rim around the second opening of said molded top, and a recessed area, said top frame having a third opening corresponding to the first opening of said exit portion and being larger than said second opening, said top frame resting in the recessed area of said molded top, the molded rim of said molded top being adjacent to said third opening.

2. The arc chute of claim 1 wherein said first and second support portions are first and second side portions; wherein said exit portion is a top portion; wherein the first and second edges of said arc plates are top and bottom edges, respectively; wherein the first and second edges of said insulating dividing members are top and bottom edges, respectively; wherein said arc plates and said insulating dividing members are generally normal to said top portion and to said first and second side portions; wherein the top edge of said arc plates is offset below said first opening of said top portion; and wherein the top edge of said insulating dividing members is within said first opening of said top portion.

3. The arc chute of claim 1 wherein said first and second support portions are first and second side portions; wherein said exit portion is a top portion; wherein the first and second edges of said arc plates are top and bottom edges, respectively; wherein the first and second edges of said insulating dividing members are top and bottom edges, respectively; wherein said arc plates and said insulating dividing members are generally normal to said top portion and to said first and second side portions; wherein the top edge of said arc plates is offset below said second opening by a first distance; and wherein the top edge of said insulating dividing members is offset below said second opening by a second distance that is smaller than said first distance.

4. The arc chute of claim 1 wherein each one of said insulating dividing members is disposed between and separated from an adjacent pair of said arc plates.

5. The arc chute of claim 1 wherein said molded top is made of an insulating material; and wherein said top frame is electrically conductive and is plated with a non-conductive material.

6. The arc chute of claim 5 wherein said molded top further includes a pair of tabs; and wherein said top frame further includes a pair of openings adapted to receive said tabs and a pair of fasteners adapted to engage and retain said tabs.

7. The arc chute of claim 1 wherein said first and second support portions include a plurality of openings; and wherein said arc plates include a plurality of tabs that engage said first and second support portions at the openings thereof.

8. The arc chute of claim 1 wherein each of said first and second support portions includes a wedge portion proximate said exit portion, said wedge portion of said first and second support portions forming a first aperture distal from said exit portion and a second aperture which is smaller than said first aperture proximate said exit portion said wedge portion being adapted to direct or divert gas toward said first opening of said exit portion.

9. The arc chute of claim 8 wherein said wedge portion is made of an insulating material and includes a plurality of first grooves adapted to engage the insulating dividing members and a plurality of opposite second grooves adapted to engage said arc plates.

10. A circuit breaker comprising:

a first power terminal;

a second power terminal;

a stationary contact electrically connected to the second power terminal;

a movable contact electrically connected to the first power terminal;

an operating mechanism adapted to open and close said stationary contact and said movable contact; and an arc chute comprising:

a first support portion, a second support portion, an exit portion supported by said first and second support portions said exit portion having at least one opening, a plurality of electrically conductive arc plates supported by said first and second support portions, said arc plates having a first edge offset from said exit portion and an opposite second edge distal from said exit portion, and a plurality of insulating dividing members disposed between said arc plates, said insulating dividing members having a first edge proximate said exit portion and an opposite second edge distal from said exit portion, wherein the second edge of said insulating dividing members extends beyond the first edge of said arc plates and toward the second edge of said arc plates, and wherein the first edge of said insulating dividing members extends beyond the first edge of said arc plates and away from the second edge of said arc plates, wherein adjacent pairs of said arc plates have slots therein with ends directed to opposite ones of said first and second support portions; and wherein for each of said pairs, each of said arc plates has a first width on a first side adjacent one of said first and second support portions and a second smaller width on a second side adjacent the other one of said first and second support portions, the second side having the smaller width being disposed proximate the end of said slot.

11. The circuit breaker of claim 10 wherein said at least one opening is a single vent opening.

12. The circuit breaker of claim 11 wherein the first and second edges of said arc plates are top and bottom edges, respectively; wherein the first and second edges of said insulating dividing members are top and bottom edges, respectively; wherein said insulating dividing members have a top portion with the top edge thereof, said top portion extending upward into said single vent opening, in order to prevent arcing over the top edge of said insulating dividing members.

13. The circuit breaker of claim 10 wherein said at least one opening is a plurality of vent openings.

14. The circuit breaker of claim 10 wherein said exit portion is a top portion; wherein the first and second edges of said arc plates are top and bottom edges, respectively; wherein the first and second edges of said insulating dividing members are top and bottom edges, respectively; wherein said insulating dividing members extend above the top edge of said arc plates and overlap said arc plates, in order to prevent an arc from said stationary contact and said movable contact, when opened by said operating mechanism, from reaching the top edge of said arc plates, without lengthening, and to cause said arc to pass below said insulating dividing members.

15. The circuit breaker of claim 10 wherein said exit portion is a top portion; wherein the first and second edges of said arc plates are top and bottom edges, respectively; wherein the first and second edges of said insulating dividing members are top and bottom edges, respectively; wherein each one of said insulating dividing members is disposed between and separated from an adjacent pair of said arc plates, in order to protect the top edge of said arc plates and prevent breakdown of an arc from said stationary contact and said movable contact, when opened by said operating mechanism, down said arc plates during interruption of said arc.

16. A circuit breaker comprising:

a first power terminal;

a second power terminal;

a stationary contact electrically connected to the second power terminal;

a movable contact electrically connected to the first power terminal;

an operating mechanism adapted to open and close said stationary contact and said movable contact; and an arc chute comprising:

a first support portion, a second support portion, an exit portion supported by said first and second support portions, said exit portion having at least one opening, a plurality of electrically conductive arc plates supported by said first and second support portions, said arc plates having a first edge offset from said exit portion and an opposite second edge distal from said exit portion, and a plurality of insulating dividing members disposed between said arc plates, said insulating dividing members having a first edge proximate said exit portion and an opposite second edge distal from said exit portion, wherein the second edge of said insulating dividing members extends beyond the first edge of said arc plates and toward the second edge of said arc plates, and wherein the first edge of said insulating dividing members extends beyond the first edge of said arc plates and away from the second edge of said arc plates, wherein said exit portion is a top portion; wherein the first and second edges of said arc plates are top and bottom edges, respectively; wherein the first and second edges of said insulating dividing members are top and bottom edges, respectively; wherein said at least one opening of said top portion is a first opening; wherein said top portion comprises a molded top and a top frame, said molded top having a second opening corresponding to the first opening of said top portion, a molded rim around the second opening of said molded top, and a recessed area, said top frame having a third opening corresponding to the first opening of said top portion and being larger than said second opening, said top frame resting in the recessed area of said molded top, the molded rim of said molded top being adjacent to said third opening.

17. The circuit breaker of claim 16 wherein said molded top is made of an insulating material; and wherein said top frame is electrically conductive and is plated with a non-conductive material.

18. A circuit breaker comprising:

a first power terminal;

a second power terminal;

a stationary contact electrically connected to the second power terminal;

a movable contact electrically connected to the first power terminal;

an operating mechanism adapted to open and close said stationary contact and said movable contact; and an arc chute comprising:

a first support portion, a second support portion, an exit portion supported by said first and second support portions, said exit portion having at least one opening, a plurality of electrically conductive arc plates supported by said first and second support portions, said arc plates having a first edge offset from said exit portion and an opposite second edge distal from said exit portion, and a plurality of insulating dividing members disposed between said arc plates, said insulating dividing members having a first edge proximate said exit portion and an opposite second edge distal from said exit portion, wherein the second edge of said insulating dividing members extends beyond the first edge of said arc plates and toward the second edge of said arc plates, and wherein the first edge of said insulating dividing members extends beyond the first edge of said arc plates and away from the second edge of said arc plates, wherein said exit portion is a top portion; wherein the first and second edges of said arc plates are top and bottom edges, respectively; wherein the first and second edges of said insulating dividing members are top and bottom edges, respectively; wherein each one of said insulating dividing members is disposed between and separated from an adjacent pair of said arc plates, wherein said top portion comprises a molded top having a bottom surface with a plurality of grooves; and wherein each of said insulating dividing members includes a top surface which interlocks with a corresponding one of said grooves of the bottom surface of said molded top.

* * * * *